United States Patent [19]

Stoppazzini

[11] Patent Number: 4,660,392

[45] Date of Patent: Apr. 28, 1987

[54] DEVICE FOR CONTROLLING THE VERTICAL TENSION OF THE KNITTED FABRIC IN AUTOMATIC FLAT KNITTING MACHINES

[75] Inventor: Benito Stoppazzini, Sala Bolognese, Italy

[73] Assignee: E.M.M. Emiliana Macchine Maglieria S.R.L., Bologna, Italy

[21] Appl. No.: 895,737

[22] Filed: Aug. 12, 1986

[30] Foreign Application Priority Data

Sep. 18, 1985 [IT] Italy ..... 3553 A/85

[51] Int. Cl.[4] ..... D04B 15/88

[52] U.S. Cl. ..... 66/149 R; 66/152

[58] Field of Search ..... 66/152, 149, 147, 150

[56] References Cited

U.S. PATENT DOCUMENTS

| | | | |
|---|---|---|---|
| 3,618,343 | 11/1971 | Essig | 66/149 R |
| 4,359,881 | 11/1982 | Baseggio et al. | 66/152 |
| 4,478,058 | 10/1984 | Kazmaier et al. | 66/149 R |
| 4,503,690 | 3/1985 | Goller | 66/149 R |

*Primary Examiner*—Ronald Feldbaum

*Attorney, Agent, or Firm*—Stevens, Davis, Miller & Mosher

[57] ABSTRACT

A device for controlling the tension of the knitted fabric includes two parallel rows of rollers, which are supported by two plane surfaces mounting two needle beds upon which a carriage is able to move longitudinally and alternately.

The rows of rollers are located beneath the needle beds with the rollers of the first row, able to turn in a single direction, being in contact with the corresponding rollers of the second row, thus creating a series of independent pairs of rollers between which the knitted fabric is inserted.

Each pair of rollers is moved by a rod, mounted on the second plane surface, featuring a heel upon which moving cams act determining the consequent rotation of the corresponding pair of rollers, while fixed cams, acting upon the heels, return the rods to their initial position.

3 Claims, 3 Drawing Figures

FIG. 1
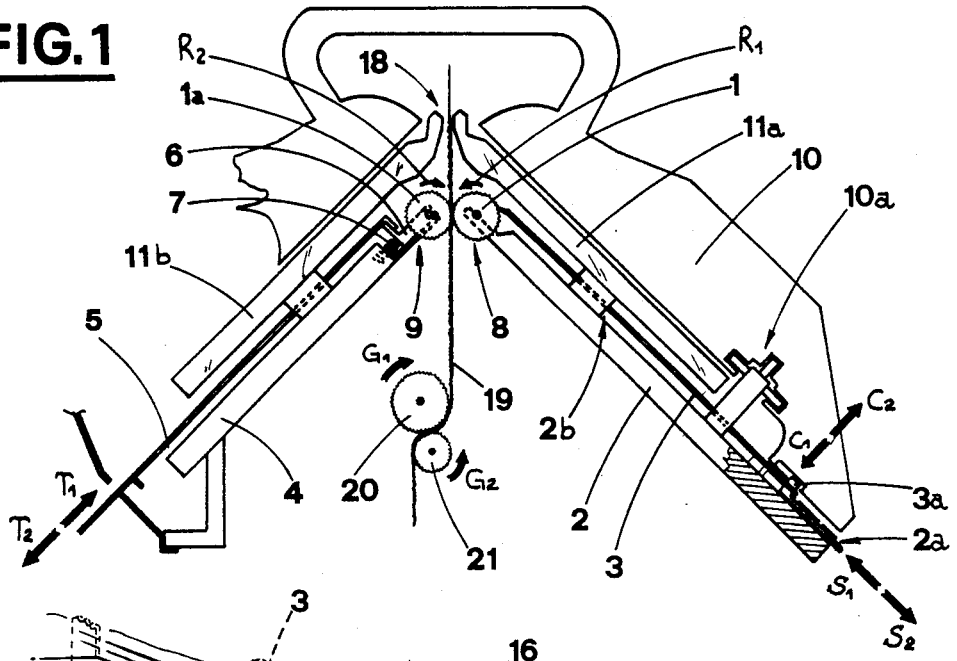
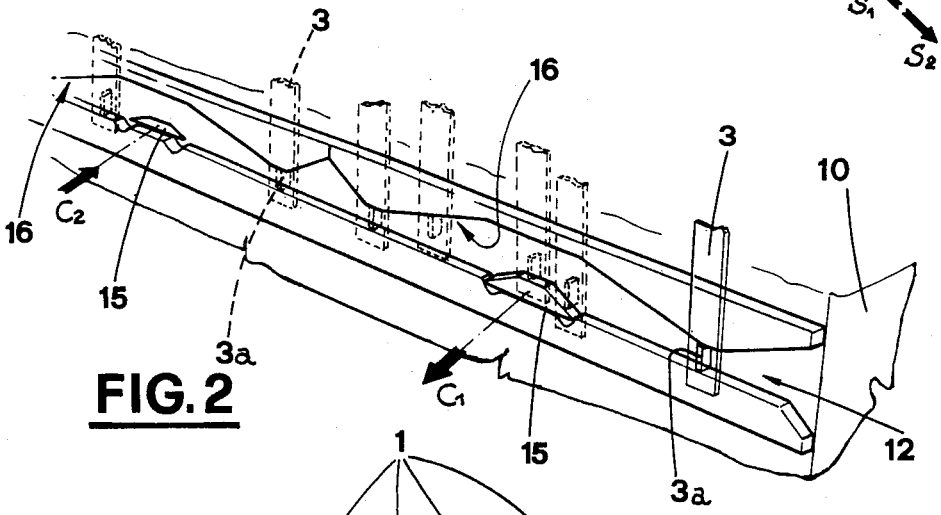
FIG. 2
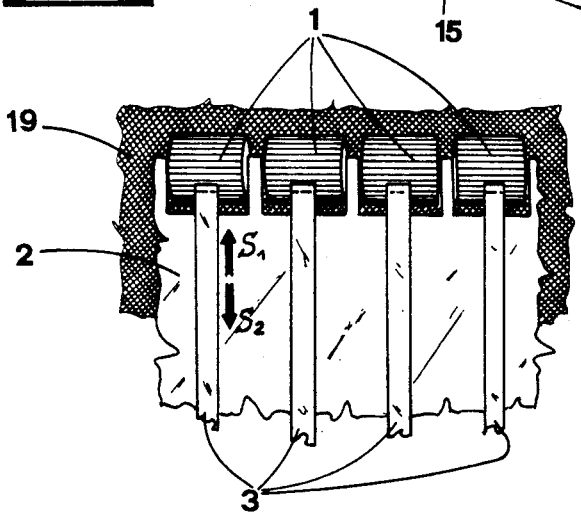
FIG. 3

DEVICE FOR CONTROLLING THE VERTICAL TENSION OF THE KNITTED FABRIC IN AUTOMATIC FLAT KNITTING MACHINES

BACKGROUND OF THE INVENTION

The present invention concerns the manufacturing sector of automatic flat knitting machines, specifically applying to devices controlling the vertical tension of the knitted fabric produced in what is known as the needles' work zone.

DESCRIPTION OF THE PRIOR ART

The aforesaid machines, that have recently been equipped with electronic control units using knitting control programs, generally maintain the vertical tension of the knitted fabric through the use of two rollers, equal in length to that of the relevent needle beds, that work in conjunction with a longitudinally moving carriage.

The circumferential surface of the rollers is longitudinally reeded. The said rollers are located, touching one another, beneath the needle bed, and parallel to this latter, rotating in opposite directions for preset times at the end of every stroke of the carriage, in accordance, for example, with the commands sent by the control unit to corresponding electric motors, following the instructions in the knitting control program.

The knitted fabric, inserted between the two rollers, is thus maintained under uniform tension by these latter, but the traction applied to the latest row of knitting being formed is not constant for the entire length of the knitted fabric.

In the first place this happens as a result of the fact that the elasticity of the knitted fabric is not uniform, above all in cases of decorated knitwear, which doesn't transmit the traction over successive rows in the same way; and in the second place because the high number of needle selection systems with which the carriage is normally equipped, gives rise to the successive formation of as many different rows as there are individual selection systems for each stroke of the carriage itself, with a consequent and progressive decrease in the tension of the knitted fabric in the work zone for those stitches because the first and last selection systems.

A known device for controlling the tension of the knitted fabric is composed of a single turning roller that extends along the entire length of a needle bed beneath which it is located, featuring a plurality of small pins over its circumferential surface, designed to pierce between the stitches of the knitted fabric.

This type of roller can be situated in an area much closer to the needles' work zone, thus minimising the effects brought about by the differing elastic reactions of the knitted fabric.

The varying tension of the knitted fabric, corresponding to the different needle selection systems, remains, however; together with all the related effects on the fabric itself.

Both the devices described above, as with others substantially of the same type, still do not permit one to optimise the production of knitted fabrics requiring, as a result of their very structure, a longitudinally differentiated tension in the row formation zone.

In such cases one normally resolves the problem by subjecting the knitted fabric to a tension the value of which lies between the minimum and maximum required, selected according to either the experience of the operator, or as the result of tests by trial and error, without, however, obtaining satisfactory results.

SUMMARY OF THE INVENTION

The object of the present invention is to produce a device able to determine the longitudinally differentiated tension, in a vertical direction, of the knitted fabric, acting upon an area of the latter as close as possible to the needles' work zone, and working on successive tracts of each row, with the possibility of independently adjusting the tension for each single tract of a row of the knitted fabric, according to the commands sent by the electronic control unit, included in the knitting program for this purpose; the entire system operating as efficiently and as simply as possible, without having any negative effects on the operating speed of the machine upon which it is intended to install the device.

The said object is achieved by means of a device for controlling the vertical tension of the knitted fabric in an automatic flat knitting machine, this latter including two flat longitudinal needle beds, mounted on two cor responding plane surfaces, respectively first and second, of a knitting machine frame to which a carriage is mounted that moves longitudinally and alternately above the aforementioned needle beds; the said device comprising: two parallel rows of co-axially mounted rollers respectively first and second, in which the rollers constituting the first row are mounted on the top longitudinal end of the aforementioned first plane surface so that they are able to turn, and the rollers constituting the second row are mounted, so that they are able to turn, on corresponding moving means mounted on the higher edge of the above mentioned second plane surface and acted upon by elastic means; the said rows of rollers being located near to the needles' work zone, each one being situated beneath a corresponding needle bed and extending along the entire length of this latter, so as to create, together with the remaining counterposed row, a series of independent pairs of rollers, each one formed of two mutually touching rollers, turning in single and reciprocally opposite directions, also acting upon one another with a preset pressure resulting from the elastic reaction of the above mentioned elastic means and between which is inserted the knitted fabric leaving the aforementioned work zone; first means for rotating the aforesaid pairs of rollers in preset steps as a result of the activation of second means, mounted on the abovementioned carriage, and acting upon the same first means in phase with the movement of the carriage.

BRIEF DESCRIPTION OF THE DRAWING

The characteristics of the invention that do not emerge from what has been stated above, are emphasised hereinafter with specific reference to the attached tables of drawings, in which:

FIG. 1 is a diagram of the device mounted on a machine which is also shown diagrammatically, seen from a headstock of this latter;

FIG. 2 is an illustration in perspective of the lower longitudinal edge of the inner side of the carriage, showing the related second means;

FIG. 3 shows a stretch of the top edge of the first plane surface, with the related rollers, and relevant stretch of knitted fabric.

DESCRIPTION OF THE PREFERRED EMBODIMENT

With reference to the said figures, shown at 2 and 4 are two longitudinal plane surfaces, first and second respectively, inclined at a preset angle, and positioned symmetrically with respect to a vertical plane; the said plane surfaces, together with other mounting means (not illustrated), constitute the load-bearing frame of an automatic flat knitting machine.

The two plane surfaces 2 and 4 are the mountings for two corresponding flat longitudinal needle beds 11*a* and 11*b*, first and second respectively, that converge higher up in the so called work zone (not illustrated) of the needles, that extends along the needle beds.

A carriage 10, that is able to move longitudinally and alternately above the needle beds, is mounted by guiding means 10*a* (of known type) upon the plane surfaces 2 and 4 below.

A plurality of selection systems of known type (not illustrated) for the aforesaid needles are mounted on the carriage 10. Below the first needle bed 11*a*, are situated, coaxial to one another, rollers 1, reeded over their circumferential surface in the direction of their axes, and constituting a first row 8 of rollers that extends along the entire length of the first needle bed itself, parallel to the same; the said rollers 1 are mounted on the top longitudinal end of the first plane surface 2 so that they are able to turn, and are subject to the action of known means (not illustrated) that permit them to rotate in a single direction R1.

Each roller 1 of the first row 8 is touched by another, substantially identical, roller 1*a*.

The other rollers 1*a*, which are also situated coaxial to one another, constitute a second row 9 that extends for the entire length of the second needle bed 11*b*, beneath which the rollers are located, subjected to the action of known means (not illustrated) which permit them to rotate in a single direction R2 that is opposite to the direction of rotation of the rollers belonging to the first row 8.

Each roller 1*a* is mounted, such that it is able to turn, on a corresponding means 6, of known type, mounted in its turn on the second plane surface 4.

Each roller 1*a* is thus able to move independently of the other rollers, parallel to the second plane surface 4, in direction T2, opposed by elastic means 7, constituted by a plurality of springs, and in direction T1, by virtue of the elastic reaction of the aforementioned springs. In this way a series of independent pairs of rollers is formed, acting upon one another with a preset pressure determined by the springs 7, and between which the knitted fabric 19 is introduced as it comes out from the work zone 18.

Within channels 2*a* and 2*b*, produced transversely in the upper surface of the first plane surface 2 beneath the corresponding needle bed 11*a*, are inserted rods 3, able to move freely, equidistant, in the same number as there are pairs of rollers, and situated perpendicular to the axes of these latter.

The rods 3, each of which is located by and operates upon a corresponding roller 1, are able to move along their axes in opposite directions S1 and S2, operative and inoperative respectively, parallel to the first plane surface 2, along lines tangential to the respective rollers 1.

Close to the lower end of each rod 3 is a heel 3*a*, turned over at its upper end, designed to be struck by corresponding moving cams 15 (when these latter are activated) as well as by fixed cams 16; both the moving cams 15 and the fixed cams 16 are located within a track 12, situated close to and alongside the inner edge of the carriage 10, on the side of this latter that faces the first needle bed 11*a*.

The moving cams 15 are moved in opposite directions C1 and C2, perpendicular to the inner side of the carriage 10 upon which track 12 is mounted, by electromechanical actuators (not illustrated) with their consequent activation or de-activation.

In practice the rods 3 are stationary whilst the carriage 10 moves longitudinally, and consequently the track 12 slides over the respective heels 3*a* that successively enter one end of the carriage and leave the other.

To more effectively show the reciprocal action between the cams and heels, it has, in FIG. 2, been assumed that the carriage 10 remains stationary and that it is the heel 3*a* that moves, sliding along within the track 12, illustrated in its successive positions; the relative movement between the carriage and the heel itself, however, remains unchanged.

The striking of the heel 3*a* by the cam 15, resulting from the activation of this latter, together with the movement of the carriage 10 causes a preset movement in an operative direction S1 of the relevant rod 3. The heel is consequently placed in the path of a fixed cam 16 which, striking the heel itself, causes it, as a result of the continued movement of the carriage 10 in the same direction, to move in an inoperative direction S2, returning the rod to its initial position.

The upper end of each rod 3, in conjunction with the fluting formed on each roller of the first row 8, effects a ratchet gear mechanism, causing the rotation, in a preset step, of the corresponding roller during the movement of the relevant rod 3 in the operative direction S1, and sliding over the roller, without any effect, during movement of the rod 3 in the inoperative direction S2.

The rollers 1 constituting the first row 8, turning in direction R1, cause the counter-rotation, in direction R2, of the rollers 1*a* constituting the second row 9. Each pair of rollers thus places the knitted fabric under traction, determining its greater or lesser tension, localised to the area of knitted fabric handled by the rollers themselves, independantly of the other areas of knitted fabric, according to the greater or lesser number of rotations the rollers are caused to move, or rather in relation to the number of movements undergone by the relevant rod 3 as a consequence of the activation of the cams 15. The activation of the moving cams 15 takes place according to the commands of an electronic control unit, programmed for the purpose, that are sent to the above-mentioned electromechanical actuators.

In this way the longitudinally differentiated control of the knitted fabric's tension according to specific work demands is achieved.

Furthermore, the simplicity of the device and its consequently compact dimensions enable it to be installed in an area very close to the work zone 18, making it possible to effect the tensioning of the knitted fabric immediately below the latest row being formed. Two rollers 20 and 21 are however incorporated, parallel and touching one another, extending along the entire length of the needle bed, and which, rotating in opposite directions G1 and G2, effect the tensioning of the knitted fabric, inserted between them, when the proposed device is de-activated.

The moving mounting means 6 can be moved by using the corresponding draw bars 5, operating them manually for example, moving one or more rollers 1*a* of the second row 9 away from the corresponding rollers of the first row 8; moving away all the rollers 1*a* of the row 9 de-activates the device.

It is understood that the description given herein is purely an unlimited example and thus that eventual variations in the construction details all fall within the protective framework afforded to the technical solution described above and claimed hereinafter.

What is claimed is:

1. A device for controlling the vertical tension of the knitted fabric in an automatic flat knitting machine, this latter including two flat longitudinal needle beds, mounted on two corresponding plane surfaces, respectively first and second, of a knitting machine frame to which a carriage is mounted that moves longitudinally and alternately above said needle beds; said device comprising: two parallel rows of co-axially mounted rollers respectively first and second, in which the rollers constituting the first row are mounted on the top longitudinal end of said first plane surface so that they are able to turn, and the rollers constituting the second row are mounted, so that they are able to turn, on corresponding moving means mounted on the higher edge of said second plane surface and acted upon by elastic means; said rows of rollers being located near to the needles' work zone, each one being situated beneath a corresponding needle bed and extending along the entire length of this latter, so as to create, together with the remaining counterposed row, a series of independent pairs of rollers, each one formed of two mutually touching rollers, turning in single and reciprocally opposite directions, also acting upon one another with a preset pressure resulting from the elastic reaction of said elastic means and between which is inserted the knitted fabric leaving said work zone; first means for rotating said pairs of rollers in preset steps as a result of the activation of second means, mounted on the above-mentioned carriage, and acting upon the same first means in phase with the movement of the carriage.

2. A device as in claim 1 wherein said first means are constituted by a plurality of rods, in a number equal to the number of pairs of rollers, equidistant from one another and situated perpendicular to the axes of the rollers, each inserted so that it can move freely in channels, formed on said first plane surface, each one working in conjunction with a pair of rollers, and able to move along its axis, parallel to the first plane surface, alternately in an operative direction and in an inoperative direction, as a result of the activation of said second means acting, when activated, upon a heel produced on every rod; each rod is designed to couple with the corresponding roller, as a result of its own movement in the operative direction, determining the rotation of the related pair of rollers, in preset steps, as well as designed to decouple from the same roller as a result of its own movement in the inoperative direction.

3. A device as in claim 2 wherein said second means are constituted by a plurality of moving cams, that can be activated and de-activated, and by a plurality of fixed cams, working within a track situated close to and alongside the lower edge of the inner side of the carriage facing the first needle bed, with said moving cams being designed to strike, when activated, said aforementioned heels relevant to said rods, inserted in the said track so that they are able to move freely, in this way they and the same rods moving in an operative direction as a result of the movement of said carriage, as well as moving the heels themselves in the path of the said fixed cams that, striking them, cause them to be moved in an inoperative direction, returning the rods to their initial position; said moving cams being activated or de-activated as a result of the movement of the same along their vertical axes in opposite directions, perpendicular to the movement of said carriage.

* * * * *